US006772671B2

(12) United States Patent
Asano et al.

(10) Patent No.: US 6,772,671 B2
(45) Date of Patent: Aug. 10, 2004

(54) ELECTROHYDRAULIC MOTOR AND HYDRAULIC DRIVING METHOD

(75) Inventors: Youji Asano, Gifu (JP); Nobuaki Shimizu, Gifu (JP)

(73) Assignee: TS Corporation, Tokyo (JP)

( * ) Notice: Subject to any disclaimer, the term of this patent is extended or adjusted under 35 U.S.C. 154(b) by 0 days.

(21) Appl. No.: 10/289,567

(22) Filed: Nov. 7, 2002

(65) Prior Publication Data

US 2003/0084781 A1 May 8, 2003

(30) Foreign Application Priority Data

Nov. 7, 2001 (JP) ..... P2001-342395

(51) Int. Cl.[7] ..... F15B 13/16
(52) U.S. Cl. ..... 91/363 R; 91/380
(58) Field of Search ..... 91/180, 362, 363 R, 91/380, 503

(56) References Cited

U.S. PATENT DOCUMENTS 3,530,764 A * 9/1970 Tamaki ..... 91/380
4,031,811 A * 6/1977 Inaba et al. ..... 91/380
4,161,905 A * 7/1979 Ota ..... 91/380
6,439,101 B1 * 8/2002 Kodama et al. ..... 91/380

FOREIGN PATENT DOCUMENTS

JP 2000-213502 A 8/2000

* cited by examiner

*Primary Examiner*—Thomas E. Lazo
(74) *Attorney, Agent, or Firm*—Akin Gump Strauss Hauer & Feld, L.L.P.

(57) ABSTRACT

There is provided an electrohydraulic motor that has a spool valve 110 for switching from each of drive positions (111, 112), in each of which a corresponding one of a main oil passage 230 and a return oil passage 240 is connected to a hydraulic actuator 130, to a neutral position, in which the hydraulic actuator 130 and each of the main oil passage 230 and the return oil passage 240 are disconnected, and vice versa. There is also provided a connection switch valve 140, which is connected to the main oil passage 230 and the return oil passage 240, for changing the connection between the main oil passage 230 and the return oil passage 240 in the neutral position 113. In response to an operation of the spool valve 110, the connection switch valve 140 connects the main oil passage 230 to the return oil passage 240 in the neutral position 113 and also disconnects the main oil passage 230 from the return oil passage 240 in the drive positions (111, 112).

3 Claims, 9 Drawing Sheets

PRIOR ART

PRIOR ART

PRIOR ART

ELECTROHYDRAULIC MOTOR AND HYDRAULIC DRIVING METHOD

BACKGROUND OF THE INVENTION

The present invention generally relates to an electrohydraulic motor for use in hydraulic shovels, asphalt finishers, machine tools, and cranes. More particularly, the invention relates to an electrohydraulic motor enabled to relieve superfluous operation oil during stoppage of a driving operation without using excessive energy.

As shown in FIG. 7, in a hydraulic drive system 700 using a conventional electrohydraulic motor, operation oil stored in a tank 710 is caused by a pump 720 to flow through a main oil passage, and then reaches a spool valve 741 provided in the electrohydraulic motor 740. The operation oil having reached the spool valve 741 is caused by movement of the spool valve 741 to flow through one of two communicating oil passages 742*a* and 742*b*. Then, the operation oil is supplied to a cylinder block (not shown) of a hydraulic actuator 743. The operation oil supplied to the cylinder block provides a pressure to a piston (not shown). In response to a sliding operation of the piston, an output shaft 743 of the hydraulic actuator 743 is rotated. When the output shaft 743 is rotated, the operation oil having provided the pressure to the piston receives a pressure from the cylinder block. Subsequently, the operation oil having received the pressure from the cylinder block flows through the other communicating oil passage 742*a* or 742*b*. Finally, such operation oil reaches the spool valve 741. This operation oil having reached the spool valve 741 is returned to the tank 710 through a return oil passage 750.

The rotation direction of the output shaft 743*a* is determined according to which of the two communicating passage 742*a* and 742*b* the operation oil having reached the spool valve 741 is supplied to, that is, which direction the spool valve 741 moves. The spool valve 741 and a drive shaft 744*a* of a pulse motor 744 are connected to each other so that each of the spool valve 741 and the drive shaft 744*a* is rotatable. Further, a rotation shaft 745 is connected to the drive shaft 744*a*. A first threaded shaft 746 is screw-connected to the rotation shaft 745. The first threaded shaft 745 engages a second threaded shaft 747 in such a way as to be perpendicular thereto. Thus, the spool valve 741 is moved by rotation of the pulse motor 744 according to the difference in the number of revolutions between the drive shaft 744*a* and the output shaft 743*a*.

Incidentally, the hydraulic actuator 743 is provided with a revolution speed changing member 748 that comprises a receptive capacity changing member 748*a* for changing the operation oil receiving capacity of the hydraulic actuator 743, a cylinder 748*b* connected to the receptive capacity changing member 748*a*, a higher-pressure oil selection valve 748*c* for drawing operation oil from one of the communicating oil passages 742*a* and 742*b*, which has a pressure higher than that of the other communicating oil passage, and a switch valve 748*d* for switching the connection between the cylinder 748*b* and the higher-pressure oil selection valve 748*c*.

To prevent the pumped operation oil from returning to the pump 720, a check valve 749 is provided in the main oil passage 730 that connects the pump 720 to the spool valve 730. Further, when the internal pressure of the main oil passage 730 becomes abnormally high, the operation oil contained in the main oil passage 730 is discharged into the tank 710 through a relief valve 760.

Furthermore, as illustrated in FIGS. 8 and 9, the conventional electrohydraulic motor has a cup-like first casing 50, and a second casing 52 fastened and fixed to the first casing 50 with bolts 52. A main oil passage 50*a*, a return oil passage 50*b*, and two communicating oil passages 50*c* and 50*d* are formed in the first casing 50.

The output shaft is rotatably supported in the first casing 50 and the second casing 52 by bearings 55 and 54, respectively. A first helical gear 56 is rotatably connected to the spool valve 59 through the bearings 54 and 55. The first helical gear 56 and a second helical gear 57, which is fixed to the output shaft, engage each other so that axes of the gears 56 and 57 are perpendicular to each other.

Annular grooves are formed in an outer peripheral portion of the spool valve 59 in such a manner as to extend in the circumferential direction thereof. When the spool valve 59 moves in the direction of a rotation shaft 58 of a pulse motor 60, the annular grooves are connected to a drain oil passage, the main oil passage 50*a*, the return oil passage 50*b*, and the communicating oil passages 50*c* and 50*d*. Further, when gears formed on the shaft 58 move, the main oil passage 50*a* and the return oil passage 50*b* are connected to the communicating oil passages 50*c* and 50*d*.

The drive shaft 58 is connected to a drive shaft 61 of the pulse motor 60, and screw-connected to the second helical gear 57. Thus, the second helical gear 57 can be moved in the direction of the drive shaft 61 by rotation of the drive shaft 61 of the pulse motor 60 (see JP-A-2000-213502).

However, in the case of the hydraulic drive system 700 using the conventional electrohydraulic motor, when the spool valve is in a neutral position, the operation oil supplied by the pump stagnates in the main oil passage. When the operation oil stagnates in the main oil passage, the internal pressure of the main oil passage increases. When the internal pressure thereof becomes high, the pump supplies the operation oil into the main oil passage by utilizing a pressure that is higher than the internal pressure of the main oil passage. Incidentally, the pressure for operating the relief valve is set at a very high value. Thus, the internal pressure of the main oil passage reaches the set pressure of the relief valve. Consequently, the conventional electrohydraulic motor has encountered a problem in that very high energy is consumed only for relieving (hereunder referred to as "bleeding off") the operation oil, which is supplied by the pump, from the relief valve.

Moreover, in the case of the conventional electrohydraulic motor, when the output shaft of the hydraulic actuator is rotated by an external force, the hydraulic actuator operates as a pump. When the hydraulic actuator operates as a pump, the operation oil is sent from one of the two communicating oil passages to the other communicating oil passage. At that time, in the case that the spool valve and the hydraulic actuator constitute a closed circuit, and that the hydraulic actuator operates as a pump, the pumped amount of operation oil is not replenished to the communicating oil passage from which the operation oil is pumped out. Consequently, a cavity is produced (hereunder, such production of a cavity will be referred to as "cavitation") in the communicating oil passage, from which the operation oil is pumped out, especially, in the conventional electrohydraulic motor adapted to perform mechanical feedback. Thus, the conventional electrohydraulic motor has encountered drawbacks caused in the hydraulic actuator owing to the cavitation, for example, a problem that the hydraulic actuator becomes uncontrollable.

Furthermore, in the conventional electrohydraulic motor, the return oil passage and the drain oil passage are not separated from each other. The drain oil passage is connected to the return oil passage. Consequently, pressure oil from the drain oil passage flows into the return oil passage that is in a high pressure condition. Thus, the conventional electrohydraulic pump has a problem that an oil seal provided at an output-shaft-side portion of the hydraulic actuator is ruptured.

SUMMARY OF THE INVENTION

Accordingly, an object of the invention is to provide an electrohydraulic motor enabled to discharge superfluous oil without consuming very high energy. Another object of the invention is to provide an electrohydraulic motor enabled to prevent the return oil passage from being put into a very high pressure condition.

To solve the aforementioned problems, according to an aspect of the invention, there is provided an electrohydraulic motor, that comprises a hydraulic drive means for rotating an output shaft by a pressure of operation oil, an electric drive means for rotating a drive shaft according to an inputted electric signal, a drive switch means, connected to the hydraulic drive means, to a main oil passage for leading operation oil supplied from the exterior, and to a return oil passage for leading operation oil to the exterior, for switching connection between the hydraulic drive means and each of the main oil passage and the return oil passage, and a connection switch means, which is connected to the main oil passage and the return oil passage, for changing connection between the main oil passage and the return oil passage. In this electrohydraulic motor, the drive switch means responds to rotation of the drive shaft to thereby switch between a drive position, in which each of the main oil passage and the return oil passage is connected to the hydraulic drive means, and a neutral position in which connection between the hydraulic drive means and each of the main oil passage and the return oil passage is disconnected. Further, the connection switch means is adapted to connect the main oil passage to the return oil passage in response to an operation of the drive switch means, and also adapted to break the connection between the main oil passage and the return oil passage.

With such a configuration, the main oil passage and the return oil passage are connected to each other by the connection switch means when the drive switch means is in the neutral position. Thus, the operation oil supplied to the main oil passage is returned to an operation oil supply source. Consequently, there is no need for bleeding off superfluous oil, which stagnates in the main oil passage, by a relief valve. Therefore, there is no necessity for consuming very high energy so as to activate and operate the pump.

Further, a flow control means for sending the drive switch means a necessary amount of operation oil supplied from the exterior and for diverting the remaining operation oil downstream can be connected to a bypass oil passage that connects the main oil passage to the connection switch means. When the drive switch means is in the drive position, the connection switch means breaks the connection between the main oil passage and the return oil passage. Thus, the operation oil sent from the main oil passage provides a pressure to the flow control means. Then, the flow control means changes the state of the flow of the operation oil in such a way as to let a necessary amount (that is, a predetermined amount needed for enabling rotation of the hydraulic actuator) of the operation oil, which is sent from the exterior, run in the direction of the drive switch means. Incidentally, the remaining operation oil is let to run downstream. On the other hand, when the drive switch means is in the neutral position, the connection switch means connects the main oil passage to the return oil passage. Thus, the operation oil, which is sent from the main oil passage, and the operation oil, which provides the pressure to the flow control means, run together toward the return oil passage. At that time, in the case that the destination of the diverted operation oil is another electrohydraulic motor, the operation oil, which is superfluous to one of the electrohydraulic motors, can be used for driving the other electrohydraulic motor. Consequently, energy for activating and operating the pump can effectively be used.

Preferably, the electrohydraulic motor according to the invention further comprises a cavitation preventing means connected to a communicating oil passage for passing operation oil through between the drive switch means and the hydraulic drive means, and to the return oil passage, and adapted to supply operation oil from the return oil passage to the communicating oil passage when the pressure of the communicating oil passage is lower than that of the return oil passage.

With such a configuration, when cavitation occurs in one of the communicating oil passages, operation oil is supplied to the communicating oil passage, in which the cavitation occurs, from the return oil passage by the cavitation preventing means. Thus, the electrohydraulic motor of the invention can avoid drawbacks caused in the hydraulic actuator owing to the cavitation, for example, a problem that the hydraulic actuator becomes uncontrollable.

According to another aspect of the invention, there is provided a hydraulic driving method, according to which torque is obtained by supplying operation oil to a hydraulic drive means enabled to generate torque by a pressure of operation oil, from the exterior, comprising the steps of performing a circulating process of supplying operation oil to the hydraulic drive means from the exterior and of returning the operation oil from the hydraulic drive means to the exterior, and performing a disconnecting process of inhibiting operation oil from circulating between the hydraulic drive means and the exterior. According to this hydraulic driving method, the operation oil supplied form the exterior is returned to the exterior together with operation oil outputted from the hydraulic drive means in the disconnecting process. Furthermore, only a necessary amount of the operation oil supplied from the exterior is fed to the hydraulic drive means in the circulating process.

With such a configuration, in the disconnecting process, the operation oil sent from the exterior is returned together with the operation oil, which is sent from the hydraulic drive means, to the exterior. In the circulating process, the operation oil sent from the exterior is supplied only to the hydraulic drive means. Thus, there is no necessity for bleeding off superfluous operation oil by using the relief valve. Moreover, this eliminates the need for consuming very high energy so as to activate and operate the pump.

Furthermore, according to another aspect of the invention, there is provided an electrohydraulic motor that comprises a hydraulic actuator for rotating an output shaft by a pressure of operation oil, an electric drive means for rotating a drive shaft according to an inputted electric signal, a spool valve, connected to the hydraulic actuator, to a main oil passage for leading operation oil supplied from the exterior, and to a return oil passage for leading operation oil to the exterior, for switching connection between the hydraulic drive means and each of the main oil passage and the return oil passage by responding to rotation of the drive shaft, a first threaded shaft connected to the spool valve, a second threaded shaft connected to the output shaft and engaged with the first threaded shaft so that said first threaded shaft is perpendicular to said second threaded shaft, and a separation wall provided in such a manner as to surround the second threaded shaft. In this electrohydraulic motor, a part of the separation wall, which part is provided at the side of the second threaded shaft, serves as a drain oil passage. Moreover, a part of the separation wall, which part is provided at the side opposite to the side of the second threaded shaft, serves as the return oil passage.

With such a configuration, the pressure oil outputted from the drain oil passage does not flow into the return oil passage that is in a high pressure condition. Thus, the internal pressure of the return oil passage does not become very high. Consequently, an oil seal provided at an output-shaft-side portion of the hydraulic actuator can be avoided from being ruptured. Therefore, the electrohydraulic motor can be applied to a series circuit to which the hydraulic actuator is series-connected, and HST (Hydrostatic Transmission) circuit for controlling the hydraulic actuator according to the discharge rate of the pump.

The present disclosure relates to the subject matter contained in Japanese patent application No. P2001-342395 (filed on Nov. 7, 2001), which is expressly incorporated herein by reference in its entirety.

DESCRIPTION OF THE PREFERRED EMBODIMENT

Hereinafter, preferred embodiments of the invention are described with reference to the accompanying drawings.

First Embodiment

Figure 1:
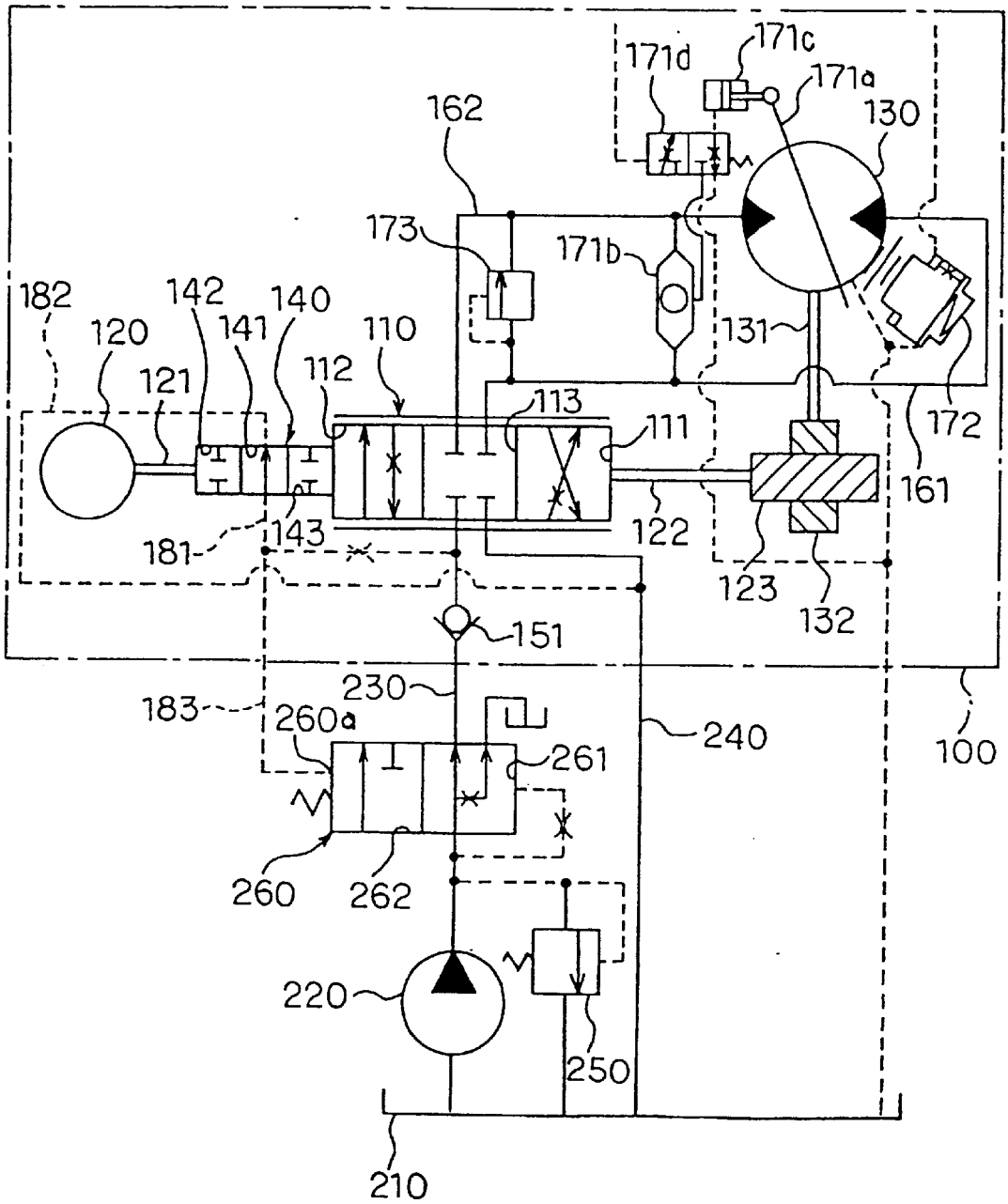
FIG. 1 is a circuit view illustrating a first embodiment of an electrohydraulic drive system using an electrohydraulic motor according to the invention.

FIG. 1 is a circuit view illustrating a first embodiment of an electrohydraulic drive system using an electrohydraulic motor according to the invention.

An electrohydraulic motor 100 has a spool valve 100, which constitutes the drive switch means, and also has an electric motor 120 (preferably, a pulse motor) constituting an electric drive means, a hydraulic actuator 130, which constitutes the hydraulic drive means, and a connection switch valve 140 constituting the connection switch means.

When operation oil is pumped up from a tank 210 by a pump 220 in the electrohydraulic motor 100, the operation oil reaches a spool valve 110 through a main oil passage 230. At that time, a check valve 151 is provided in the main oil passage 230 so as to prevent the operation oil from flowing back toward the tank 210.

The operation oil having reached the spool valve 110 flows into communicating oil passages 161 and 162 through the spool valve 110. At that time, the spool valve 110 is rotatably connected to the rotation shaft 122 of the electric motor 120 by bearings. The spool valve 110 is controlled by rotation of the electric motor 120 in such a manner as to connect the main oil passage 230 to the communicating oil passage 161 or 162.

Practically, when passing through the first drive position 111, the operation oil having reached the spool valve 110 flows into the first communicating oil passage 161. On the other hand, when passing through the second drive position 112, the operation oil having reached the spool valve 110 flows into the second communicating oil passage 162.

The operation oil having flowed into the communicating oil passage 161 or 162 is supplied to the pressure chambers of the cylinder block of the hydraulic actuator 130, and then moves a piston by an oil pressure. When the piston is moved by the oil pressure, the cylinder block slides on a slanted plate. A cylinder block consisting of a plurality of pressure chambers is arranged in such a way as to extend in a direction of the output shaft 131 and as to surround the outer periphery of the output shaft 131. The output shaft 131 rotates in response to the sliding motion of the cylinder block.

At that time, the direction of rotation of the output shaft 131 is determined by an operation oil supply channel. For example, in the case of using the electrohydraulic drive system in a crane, when operation oil is supplied to the cylinder block through the first communicating oil passage 161, the output shaft 131 is rotated in a direction in which a rope is wound up. On the other hand, when operation oil is supplied to the cylinder block through the second communicating oil passage 162, the output shaft 131 is rotated in a direction in which a rope is wound off.

Further, an amount of operation oil to be supplied to the cylinder block is determined by the opening of the spool valve 110. That is, an amount of operation oil required to operate the hydraulic actuator 130 is determined by the opening area of the spool valve 110, which is automatically balanced. The rotation shaft 122 is connected to the drive shaft 121. The first threaded shaft 123 is screw-connected to the rotation shaft 122. Further, the second threaded shaft 132 is connected to the output shaft 131 of the hydraulic actuator 130. The first threaded shaft 123 and the second threaded shaft 132 engage each other so that the directions of these shafts are perpendicular to each other. The spool valve 110 moves in the direction of the axis thereof according to the difference in the number of revolutions between the rotation shaft 122 and the output shaft 131 to thereby adjust the opening thereof.

Incidentally, a speed change member 171*a* for changing the revolution speed of the output shaft 131 by changing the capacity of the pressure chambers of the cylinder block. The speed change member 171*a* operates by supplying operation oil, which is selected by a high-pressure oil selecting valve 171*b*, to a cylinder 171*c* and by draining such operation oil therefrom. The supplying and draining of the operation oil is performed by feeding pressure oil into a changeover valve 171*d* and deriving the pressure oil therefrom. Further, a parking brake 172 adapted to be operated by feeding and deriving the pressure oil is provided in the hydraulic actuator 130. Thus, an operation of the hydraulic actuator is directly stopped.

When the piston receives a pressure from the slanted plate with rotation of the output shaft 131, the operation oil supplied to the cylinder block is discharged to the communicating oil passages 161 or 162. At that time, the operation oil is discharged to the second communicating oil passage in the case that the operation oil is supplied to the cylinder block through the first communicating oil passage 161. On the other hand, when the operation oil is supplied thereto through the second communicating oil passage 162, the operation oil is discharged to the first communicating oil passage 161. Incidentally, high-pressure oil generated in the first communicating oil passage 161 is relieved to the second communicating oil passage 162 by using a pressure control valve 173 connected in parallel with the first communicating oil passage 161 and the second communicating oil passage 162.

The operation oil discharged to the communicating oil passage 161 or 162 flows to the return oil passage 240 through the spool valve 110. Because the return oil passage 240 is connected to the tank 210, the operation oil flowing to the return oil passage 240 is used for driving the hydraulic actuator 130 again.

Meanwhile, when the spool valve 110 is in the neutral position 113, operation oil supplied from the tank 210 is blocked by the spool valve 110. When blocked by the spool valve 110, the operation oil passes through a first drain oil passage 181 and reaches the connection switch valve 140. The connection switch valve 140 is connected to the connection shaft 122 of the electric motor 120, similarly as the spool valve 110. Further, the connection switch valve 140 follows an operation of the spool valve 110. When the spool valve 110 is in the neutral position 113, the connection switch valve 140 moves to a position 141 in which the first drain oil passage 181 is connected to the second drain oil passage 182. On the other hand, when the spool valve 110 is in the driving position 111 or 112, the connection switch valve 140 moves to a position 142 or 143, in which the first drain oil passage 181 is disconnected from the second drain oil passage 182.

The operation oil having flowed into the second drain oil passage 182 is returned to the tank 210 through the return oil passage 240. Thus, superfluous operation oil is relieved through the return oil passage 240 before relieved from the relief valve 250. This eliminates the necessity for operating the pump 220 until the relief valve 250 is activated.

Incidentally, it is possible that a flow control valve 260 is provided in the main oil passage 230 connecting the pump 220 to the spool valve 110, and that the flow control valve 260 is connected to the first drain oil passage 181 by a third drain oil passage 183.

In this case, in the case that the spool valve 110 connects the main oil passage 230 to the communicating oil passage 161 or 162, the connection switch valve 140 disconnects the first drain oil passage 181 from the second drain oil passage 182. Thus, operation oil diverted from the main oil passage 230 to the first drain oil passage 181 is led to an end of the flow control valve 260. Then, the flow control valve 260 is moved in such a way as to let all the operation oil, which is supplied from the pump 220, flow to the spool valve 110.

Figure 2:
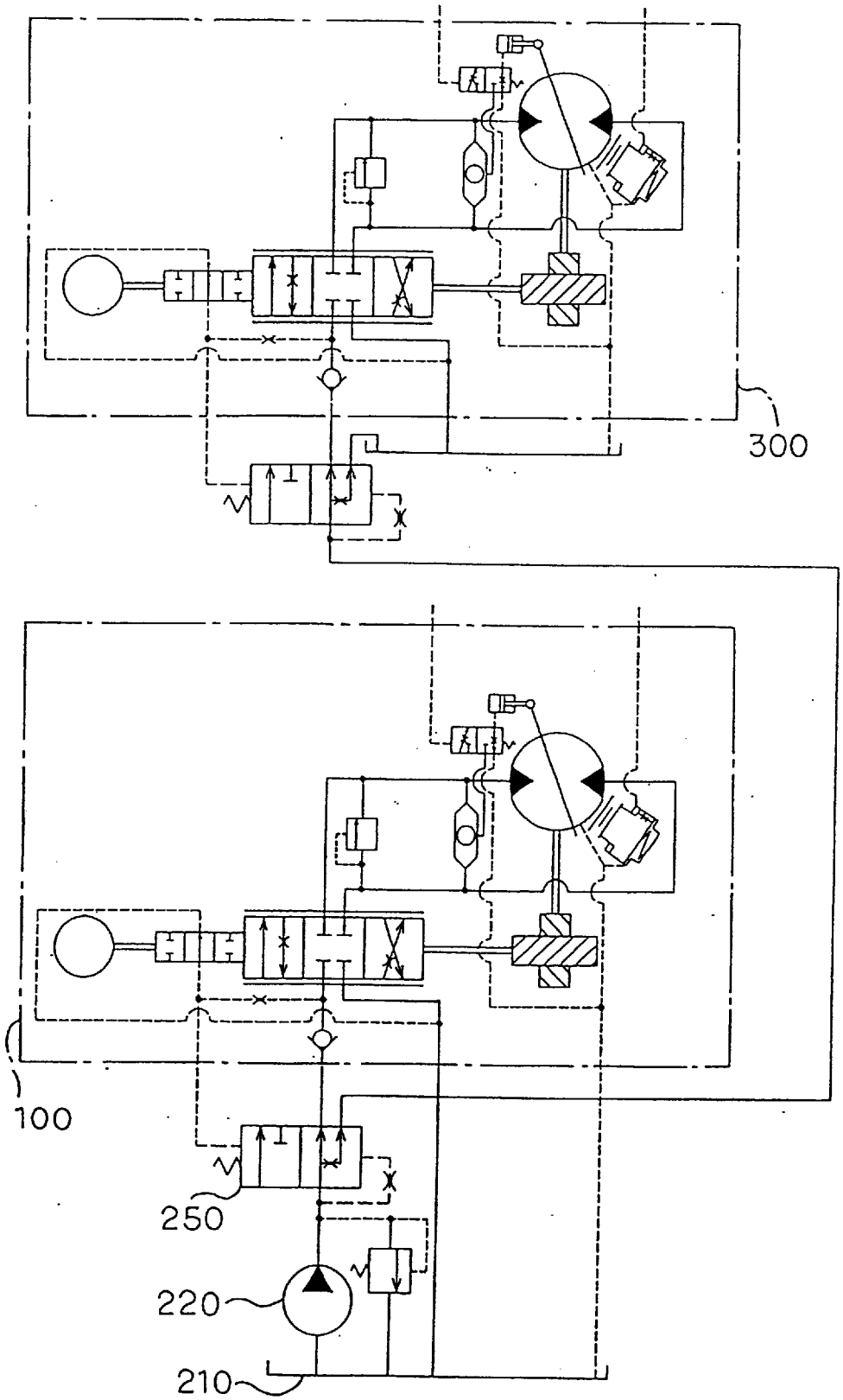
FIG. 2 is a circuit view illustrating the case of constituting a tandem circuit by using two electrohydraulic motors according to the invention.

On the other hand, when the spool valve 110 disconnects the oil passage 230 from the communicating oil passages 161 and 162, the connection switch valve 140 connects the first drain oil passage 181 to the second drain oil passage 182. Thus, the operation oil having been led to the end of the flow control valve 260 flows into the second drain oil passage 182 together with the operation oil having been diverted to the first drain oil passage 181. The flow control valve 260 is moved in such a manner as to divert the operation oil having been supplied from the pump 220. Especially, in the case that a tandem circuit is configured by employing another electrohydraulic motor 300 as a destination, to which operation oil is diverted, as illustrated in FIG. 2, one of the other electrohydraulic motors 100 is stopped. Even when superfluous operation oil is produced, the superfluous operation oil is supplied to the other electrohydraulic motor 300. Thus, the other electrohydraulic motor 300 can be driven.

Incidentally, the pump 220 may be either a stationary pump, whose discharge rate is constant, or a variable pump whose discharge rate is variable.

Second Embodiment

Figure 3:
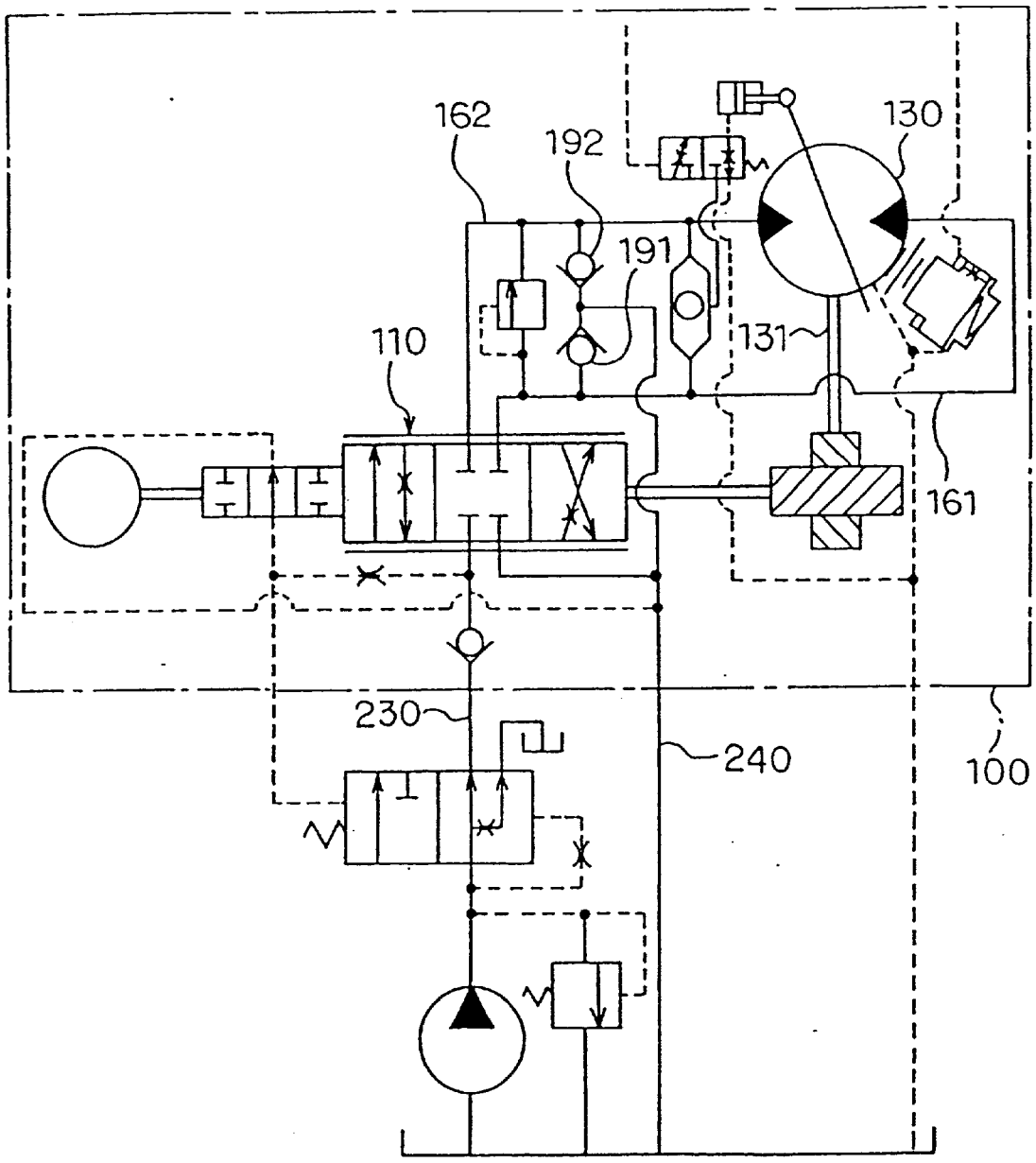
FIG. 3 is a circuit view illustrating a second embodiment of the electrohydraulic drive system using the electrohydraulic motor according to the invention.

FIG. 3 is a circuit view illustrating a second embodiment of the electrohydraulic drive system using the electrohydraulic motor according to the invention. Basically, the configuration of an electrohydraulic motor 100 of the second embodiment is the same as that of the electrohydraulic motor 100 of the first embodiment. Therefore, the description of like parts is omitted.

In the electrohydraulic motor 100, a first check valve 191 and a second check valve 192 of the cavitation preventing means are provided in a first communicating oil passage 161 and a second communicating oil passage 162, respectively. Each of the first check valve 191 and the second check valve 192 is connected to the return oil passage 240. The first check valve 191 operates in such a way as to supply the operation oil, which is sent from the return oil passage 240, to the first communicating oil passage 161. Further, the second check valve 192 operates in such a manner as to supply the operation oil, which is sent from the return oil passage 240, to the second communicating oil passage 162.

By way of practical example, consider the case that the electrohydraulic system is used in a crane. When an operation of a hydraulic actuator 130 is stopped during a state in which the crane winches up a load, the spool valve 110 disconnects the communicating oil passages 161 and 162 from the main oil passage 230 and the return oil passage 240. Thus, a closed circuit is formed between the hydraulic actuator 130 and the spool valve 110. When a rope is pulled in the direction of gravity owing to the own weight thereof during this state, an output shaft 130 rotates in a winding-off direction. This rotation causes the hydraulic actuator 130 to operate as a pump 220. Because the closed circuit is formed between the hydraulic actuator 130 and the spool valve 110, cavitation occurs in the second communicating oil passage 162. At occurrence of the cavitation in the second communicating oil passage 162, a pressure applied from the second communicating oil passage 162 to the second check valve 192 becomes less than a pressure applied thereto from the return oil passage 240. Consequently, the second check valve 192 is opened to the second communicating oil passage 162. Operation oil sent from the return oil passage 240 is supplied to the second communicating oil passage 162. The cavitation is eliminated. Similarly, when cavitation occurs in the first communicating oil passage 161, operation oil is supplied from the first check valve 191 to the first communicating oil passage 161, so that the cavitation is eliminated.

Incidentally, a pump 220 may be either a stationary pump, whose discharge rate is constant, or a variable pump whose discharge rate is variable.

Third Embodiment

Figure 4:
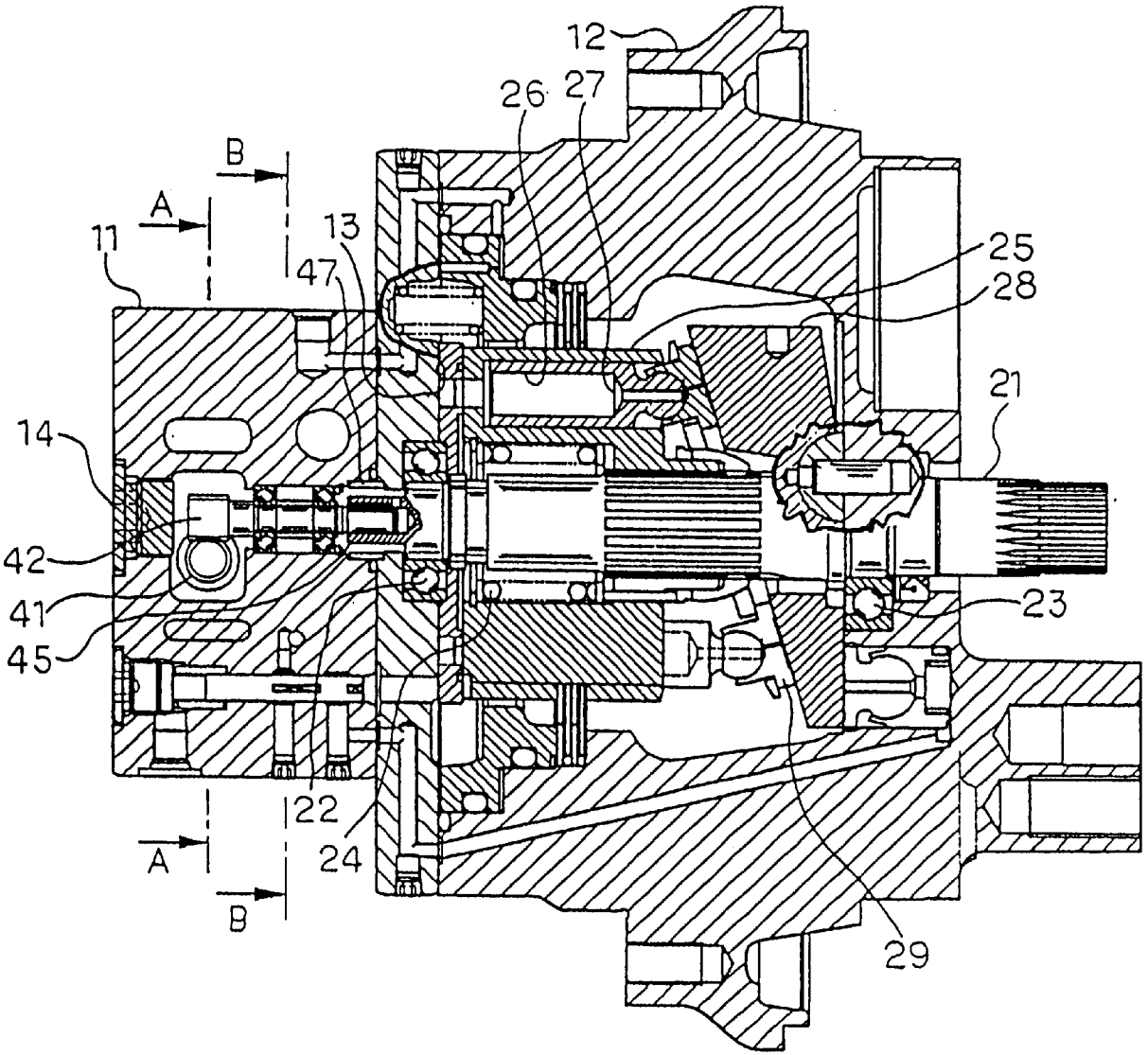
FIG. 4 is a sectional view illustrating a third embodiment of the electrohydraulic motor according to the invention.
Figure 5:
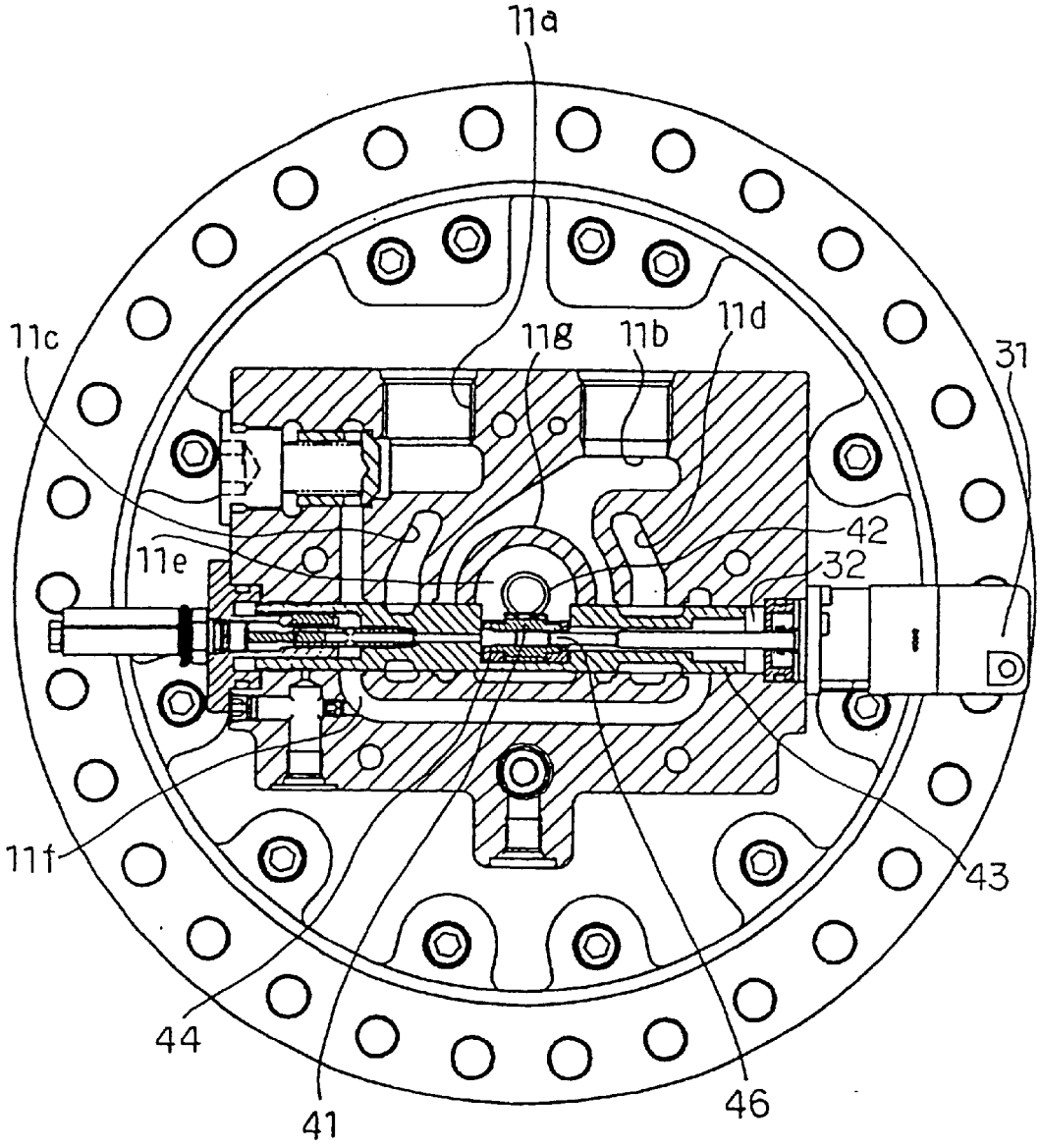
FIG. 5 is a sectional view taken along line A—A of FIG. 4.
Figure 6:
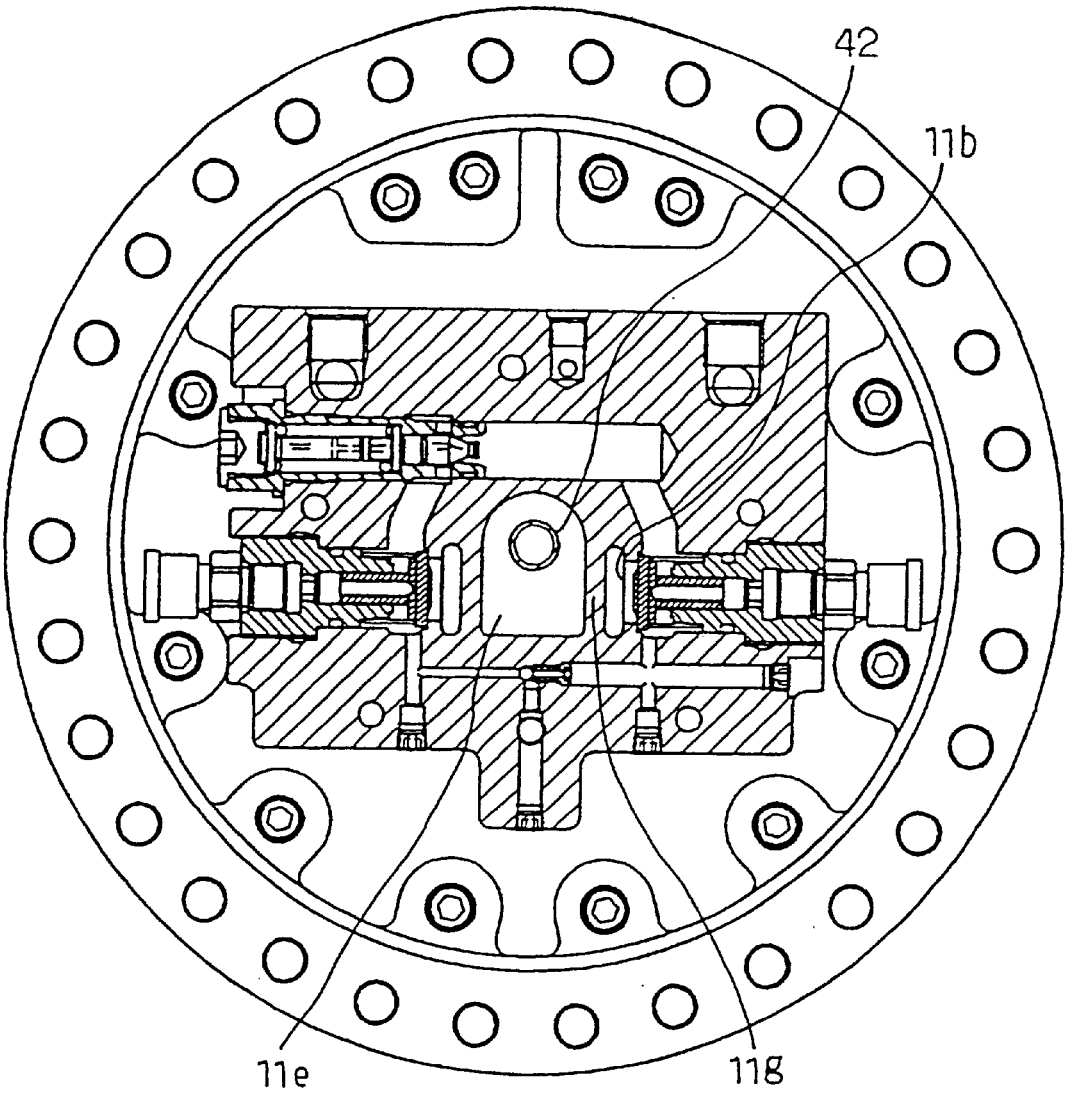
FIG. 6 is a sectional view taken along line B—B of FIG. 4.
Figure 7:
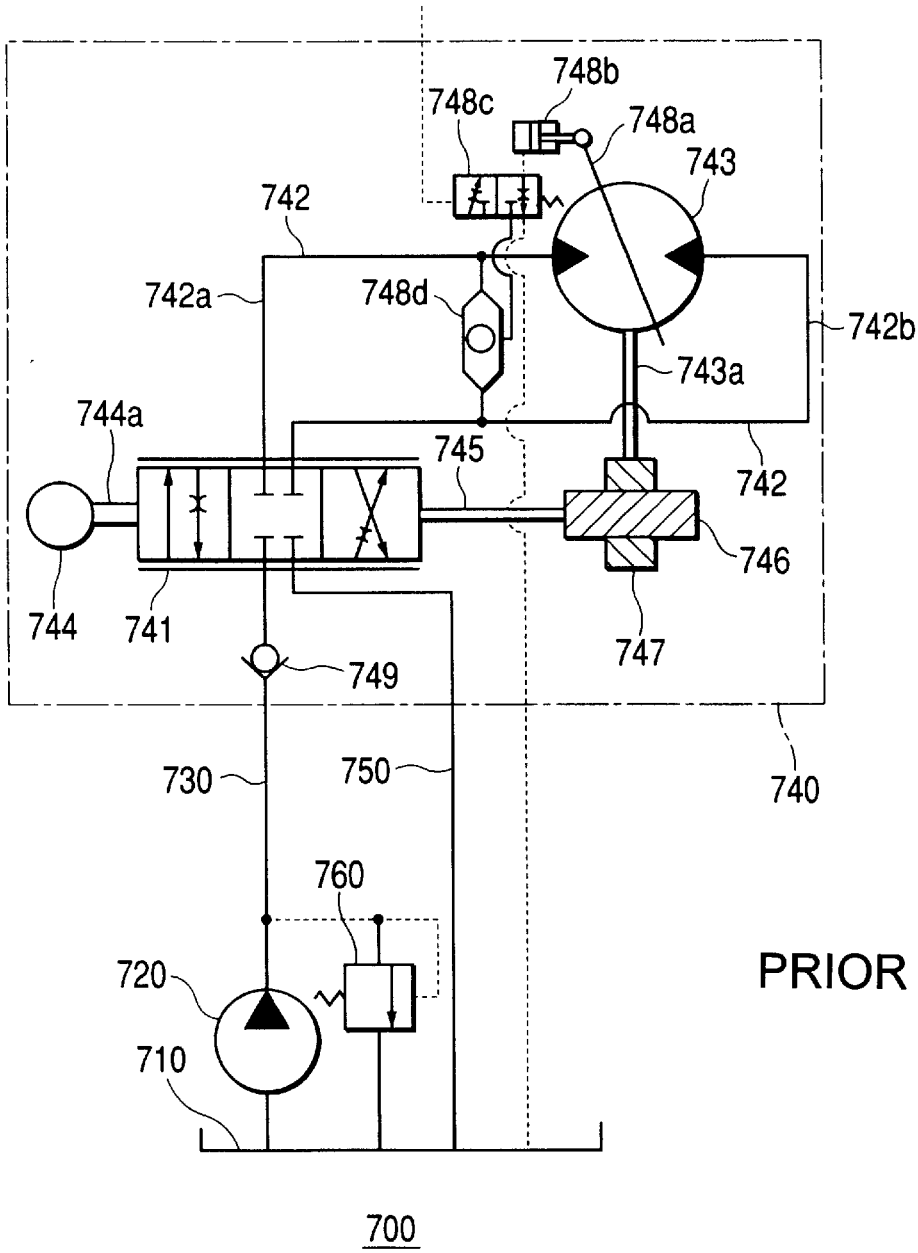
FIG. 7 is a circuit view illustrating a conventional electrohydraulic motor.
Figure 8:
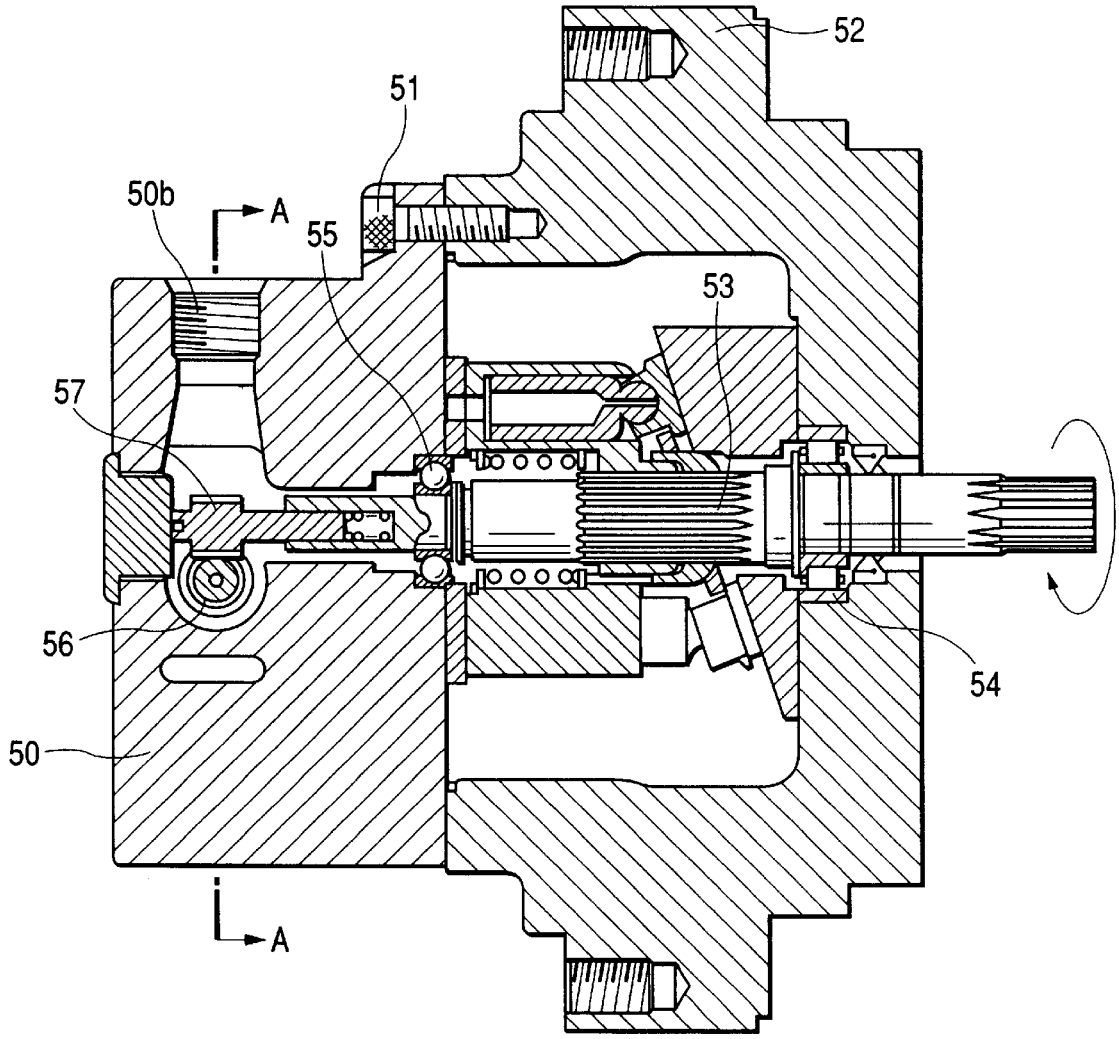
FIG. 8 is a sectional view illustrating the conventional electrohydraulic motor.
Figure 9:
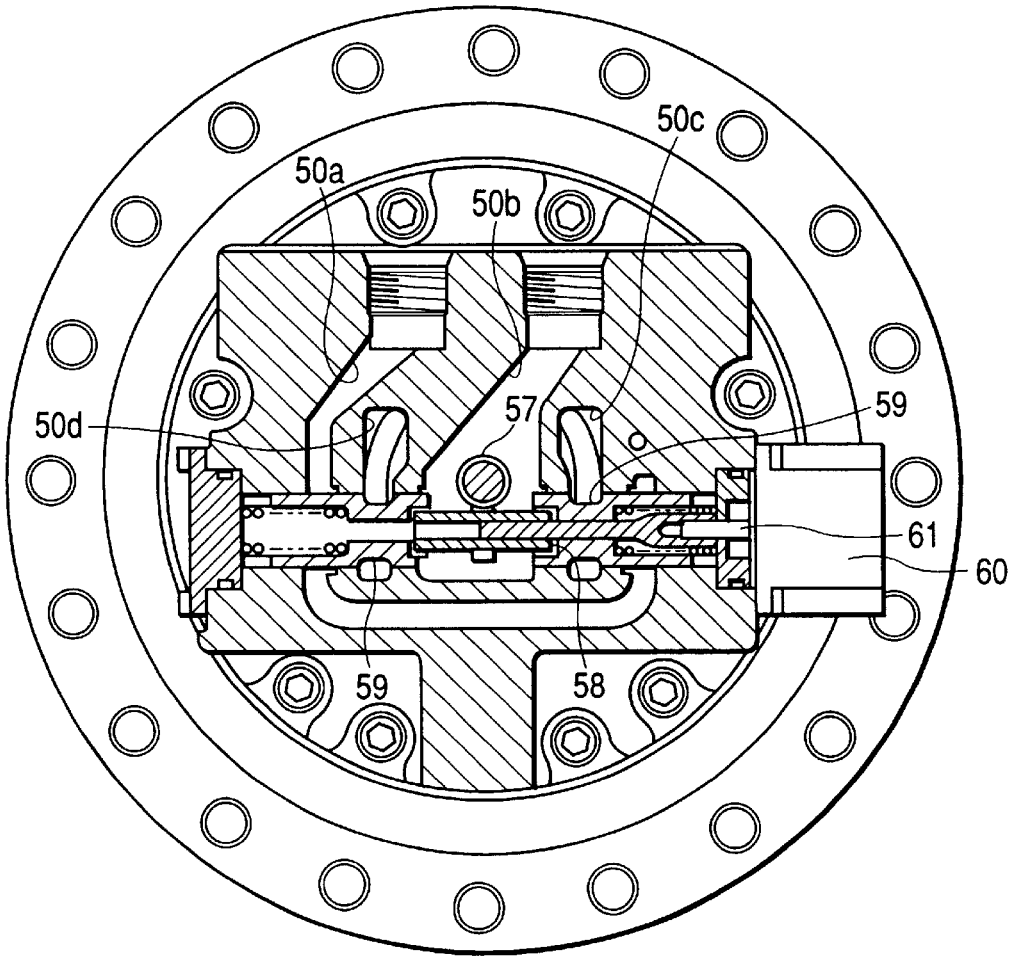
FIG. 9 is a sectional view taken along line A—A of FIG. 8.

As shown in FIGS. 4 to 6, an electrohydraulic motor according to invention has a cup-like first casing 11, and a second casing 12 fastened and fixed to the first casing 11 with bolts. A main oil passage 11*a*, a return oil passage 11*b*, a drain oil passage 11*e*, and two communicating oil passages 11*c* and 11*d* are formed in the first casing 11. An output shaft 21 is rotatably supported in the first casing 11 and the second casing 12 by bearings 22 and 23, and pushed by a spring 24 toward an end thereof. An end portion of the output shaft 21, which projects outside the second casing 12, is connected to a drive portion of an external apparatus (not shown). Torque is transmitted to such a drive portion.

A valve plate 13 is fixed to a side wall of the first casing 11, which is placed at the other end of the output shaft 21. The output shaft 21 is passed through a central portion of the valve plate 13. Circular holes communicated with the communicating oil passages 11*c* and 11*d* are concentrically formed in the valve plate 13. Operation oil is supplied to and discharged from pressure chambers 26 of the cylinder block 25.

The cylinder block 25 is fixed to the peripheral portion of the output shaft 21. The cylinder block 25 has a plurality of pressure chambers 26 each having an axis parallel to the output shaft 21, which are arranged in a circumferential direction thereof at uniform intervals. Each of the pressure chambers 26 has a piston 27 that is provided therein and adapted to slide in the direction of an axis thereof. Each of the pistons 27 performs a reciprocating motion in response to the supply and discharge of operation oil.

A slanted plate 28 sloping toward the output shaft 21 passed through the central portion at a predetermined angle therewith is formed on an inner wall of the second casing 12. A shoe member 29 rollably engages an end portion of the piston 27. This end portion of the piston 27 pushes against a slope through the shoe member 29. When the end portion pushes the slope, the shoe member 29 slides on the slanted plate 28. The cylinder block 25 rotates together with the output shaft 21 by simultaneously being in slide contact with the valve plate 13.

A first helical gear 41 constituting the first threaded shaft engages a second helical gear 42 constituting the second threaded shaft so that the directions of axes of these gears are perpendicular to each other. The first helical gear 41 is rotatably connected to the spool valve at both ends thereof through a bearing 44. A second helical gear 42 has an end fixed to the output shaft 21 by a connecting member 45, and also has the other end rotatably supported by a cap cover 14. Incidentally, although helical gears are used as the threaded shafts in this embodiment, the threaded shafts are not limited thereto.

A pulse motor 31 constituting the electric motor is mounted on an outer wall of the first casing 11. A rotation shaft 46 is connected to a drive shaft 32 of the pulse motor 31, and screw-connected to the first helical gear 41. Thus, the first helical gear 41 can be moved in the direction of the drive shaft 32 by rotation of the drive shaft 32 of the pulse motor 31. Further, as described above, the first helical gear 41 and the second helical gear 42 engage each other so that the directions of axes of these gears are perpendicular to each other. When a difference in the number of revolutions is caused between the first helical gear 41 and the second helical gear 42, the first helical gear 41 performs a screwing motion with respect to the rotation shaft 46 and moves in the direction of the rotation shaft 46. As the first helical gear 41 moves, the spool valve moves in the direction of an axis thereof, so that the opening percentage of an annular groove 11*f* changes.

The annular groove 11*f* is formed in the direction of the outer periphery of the spool valve. The opening percentage of the annular groove 11*f* is controlled by the movement of the spool valve. The annular groove 11*f* communicates with the main oil passage 11*a*, the return oil passage 11*b*, and the communicating oil passages 11*c* and 11*d*, which are formed in the first casing 11. That is, as illustrated in FIG. 5, when the first helical gear 41 moves in the direction of the pulse motor 31, the main oil passage 11*a* communicates with the communicating oil passage 11*c*. Further, the return oil passage 11*b* communicates with the communicating oil passage 11*d*. Furthermore, in the case that a load is applied to the external apparatus, and that the number of revolutions of the output shaft 21 is reduced, the number of revolutions of the second helical coil 42 decreases. This causes a difference in the number of revolutions between the first helical gear 41 and the second helical gear 42. When such a difference in the number of revolutions is caused therebetween, the first helical gear 41 performs a screwing motion with respect to the rotation shaft 46, and moves in the direction of the rotation shaft 46. As the first helical gear 41 moves, the spool valve moves in the direction of the axis thereof. Consequently, the opening percentage of the annular groove 11*f* increases.

A separation wall 11*g* is formed in the first casing 11, an separates the return oil passage 11*b* from the second helical gear 42. Between spaces bordering the separation wall 11*g*, the space formed at the side of the second helical gear 42 serves as the drain oil passage 11*e*. As illustrated in FIGS. 5 and 6, the drain oil passage 11*e* and the return oil passage 11*b* are separated from each other. Devices (not shown), such as a parking brake, adapted to operate by pressure oil are provided in the electrohydraulic motor. The pressure oil having been used for operating such devices flows through the drain oil passage 11*e*, which is separated from the return oil passage 11*b*, and is discharged to an external tank 710. Thus, the internal pressure of the return oil passage 11*b*, which is in a high pressure condition, does not increase still more. Therefore, an oil seal 47 provided at the side of the output shaft 21 is not damaged by the pressure oil.

According to the invention, when the drive switch means is in the neutral position, the main oil passage is connected to each other by the connection switch means. Further, superfluous operation oil supplied into the main oil passage is returned to a supply source of the operation oil through the return oil passage. Thus, there is no need for bleeding off the superfluous operation oil, which stagnates in the main oil passage, by using the relief valve. Moreover, this can eliminate the necessity for consuming very high energy so as to activate and operate the pump 720.

Furthermore, in the case that the electrohydraulic motor of the invention and the flow control means, which is used for switching whether all the operation oil supplied from the exterior is sent to the drive switch means or a part of such operation oil is diverted, are simultaneously used, operation oil, which is superfluous to one of the electrohydraulic motors, can be used for driving the other electrohydraulic motor. Thus, energy for activating and operating the pump 720 can effectively be utilized.

What is claimed is:

1. An electrohydraulic motor, comprising:

hydraulic drive means for rotating an output shaft by a pressure of operation oil;

electric drive means for rotating a drive shaft according to an inputted electric signal;

drive switch means, connected to said hydraulic drive means, to a main oil passage for leading operation oil supplied from the exterior, and to a return oil passage for leading operation oil to the exterior, for switching connection between said hydraulic drive means and each of said main oil passage and said return oil passage; and connection switch means, connected to said main oil passage and said return oil passage, for changing connection between said main oil passage and said return oil passage, wherein said drive switch means responds to rotation of said drive shaft to thereby switch between a drive position, in which each of said main oil passage and said return oil passage is connected to said hydraulic drive means, and a neutral position in which connection between said hydraulic drive means and each of said main oil passage and said return oil passage is disconnected, and wherein said connection switch means is adapted to connect said main oil passage to said return oil passage in response to an operation of said drive switch means, and also adapted to break the connection between said main oil passage and said return oil passage.

2. The electrohydraulic motor according to claim 1, which further comprises cavitation preventing means connected to a communicating oil passage for passing operation oil through between said drive switch means and said hydraulic drive means, and to said return oil passage, and adapted to supply operation oil from said return oil passage to said communicating oil passage when a pressure of said communicating oil passage is lower than that of said return oil passage.

3. An electrohydraulic motor comprising:

a hydraulic actuator for rotating an output shaft by a pressure of operation oil;

an electric drive motor for rotating a drive shaft according to an inputted electric signal;

a spool valve, connected to said hydraulic actuator, to a main oil passage for leading operation oil supplied from the exterior, and to a return oil passage for leading operation oil to the exterior, for switching connection between said hydraulic actuator and each of said main oil passage and said return oil passage by responding to rotation of said drive shaft;

a first threaded shaft connected to said spool valve;

a second threaded shaft connected to said output shaft and engaged with said first threaded shaft so that said first threaded shaft is perpendicular to said second threaded shaft; and a separation wall provided in such a manner as to surround said second threaded shaft, wherein a part of said separation wall, which part is provided at the side of said second threaded shaft, serves as a drain oil passage, and wherein a part of said separation wall, which part is provided at a side opposite to the side of said second threaded shaft, serves as said return oil passage.

* * * * *